US007867043B2

(12) United States Patent
Yuan et al.

(10) Patent No.: US 7,867,043 B2
(45) Date of Patent: Jan. 11, 2011

(54) ELECTRICAL CONTACT WITH STOPPER AND ELECTRICAL CONNECTOR HAVING THE SAME

(75) Inventors: Pei-Liang Yuan, Shenzhen (CN); Qi-Lin Liao, Shenzhen (CN); Fu-Jin Peng, Shenzhen (CN); Hui Ye, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/577,749

(22) Filed: Oct. 13, 2009

(65) Prior Publication Data

US 2010/0093191 A1 Apr. 15, 2010

(30) Foreign Application Priority Data

Oct. 14, 2008 (CN) ..... 2008 2 0186072

(51) Int. Cl.
*H01R 13/11* (2006.01)

(52) U.S. Cl. ..... 439/857

(58) Field of Classification Search ..... 439/857, 439/342, 66, 856–858, 259
See application file for complete search history.

(56) References Cited

U.S. PATENT DOCUMENTS

| | | | | |
|---|---|---|---|---|
| 5,766,045 | A * | 6/1998 | Sawaki et al. | 439/857 |
| 6,471,534 | B1 * | 10/2002 | Lee | 439/342 |
| 6,554,634 | B1 | 4/2003 | Lin et al. | |
| 6,773,290 | B2 * | 8/2004 | Lai | 439/342 |
| 7,074,055 | B2 * | 7/2006 | Yang et al. | 439/83 |
| 7,727,032 | B2 * | 6/2010 | Szu | 439/857 |

* cited by examiner

*Primary Examiner*—Jean F Duverne
(74) *Attorney, Agent, or Firm*—Andrew C. Cheng; Wei Te Chung; Ming Chieh Chang

(57) ABSTRACT

An electrical contact (20) for using in a CPU (central processing unit) socket, includes a planar base portion (201), a pair of flexible arms (203) extending from the planar base portion, a pair of contact portions (204) being orthogonal to the flexible arms, a pair of stopper portions (205) coplanarly formed on the flexible arms and a solder portion (206) being orthogonal to the planar base portion and extending parallel to the contact portions.

3 Claims, 2 Drawing Sheets

ELECTRICAL CONTACT WITH STOPPER AND ELECTRICAL CONNECTOR HAVING THE SAME

CROSS-REFERENCE TO RELATED APPLICATIONS

This patent application relates to a co-pending U.S. patent application Ser. No. 12/549,399 filed on Aug. 28, 2009, entitled "ELECTRICAL CONTACT WITH MULTIPLE CONTACTING POINTS", and a co-pending U.S. patent application Ser. No. 12/574,788, filed on Oct. 7, 2009, entitled "ELECTRICAL CONTACT WITH STOPPER AND ELECTRICAL CONNECTOR HAVING THE SAME", which have the same assignee as the present invention.

BACKGROUND OF THE INVENTION

1. Field of the Invention

The present invention relates generally to an electrical contact, and more particularly to a ZIF (zero insertion force) contact having a stopper portion preventing over-slippage of a pin leg of a CPU.

2. Description of Related Arts

U.S. Pat. No. 6,554,634 issued to Lin et al. on Apr. 29, 2003 discloses an electrical contact connecting a pin leg of a CPU (central processing unit) onto a PCB (printed circuit board). The electrical contact has a base portion, a solder portion extending from the base portion, and a pair of spaced arms. Each arm has a body section extending from the base portion and a finger including a lead-in section extending from the body section and a contact section extending from the lead-in section. The lead-in sections of the fingers are coined to define planar lead-in surfaces for guiding the pin leg of the CPU into the contact sections with zero insertion force. However, the contact sections define an opening slot to the air, and the pin leg of the CPU easily over slips beyond the contact section because there is no obstacle for the pin leg. The electrical connection between the CPU and the PCB is destroyed.

Hence, an electrical contact preventing over-slippage of a pin leg of a CPU is desired.

SUMMARY OF THE INVENTION

Accordingly, an object of the present invention is to provide an electrical contact having a stopper portion preventing over-slippage of a pin leg of an CPU.

To achieve the above object, an electrical contact for using in a CPU (central processing unit) socket, includes a planar base portion, a pair of flexible arms extending from the planar base portion, a pair of contact portions being orthogonal to the flexible arms, a pair of stopper portions coplanarly formed on the flexible arms and a solder portion being orthogonal to the planar base portion and extending parallel to the contact portions.

Other objects, advantages and novel features of the invention will become more apparent from the following detailed description when taken in conjunction with the accompanying drawings.

DETAILED DESCRIPTION OF THE PREFERRED EMBODIMENT

Figure 1:
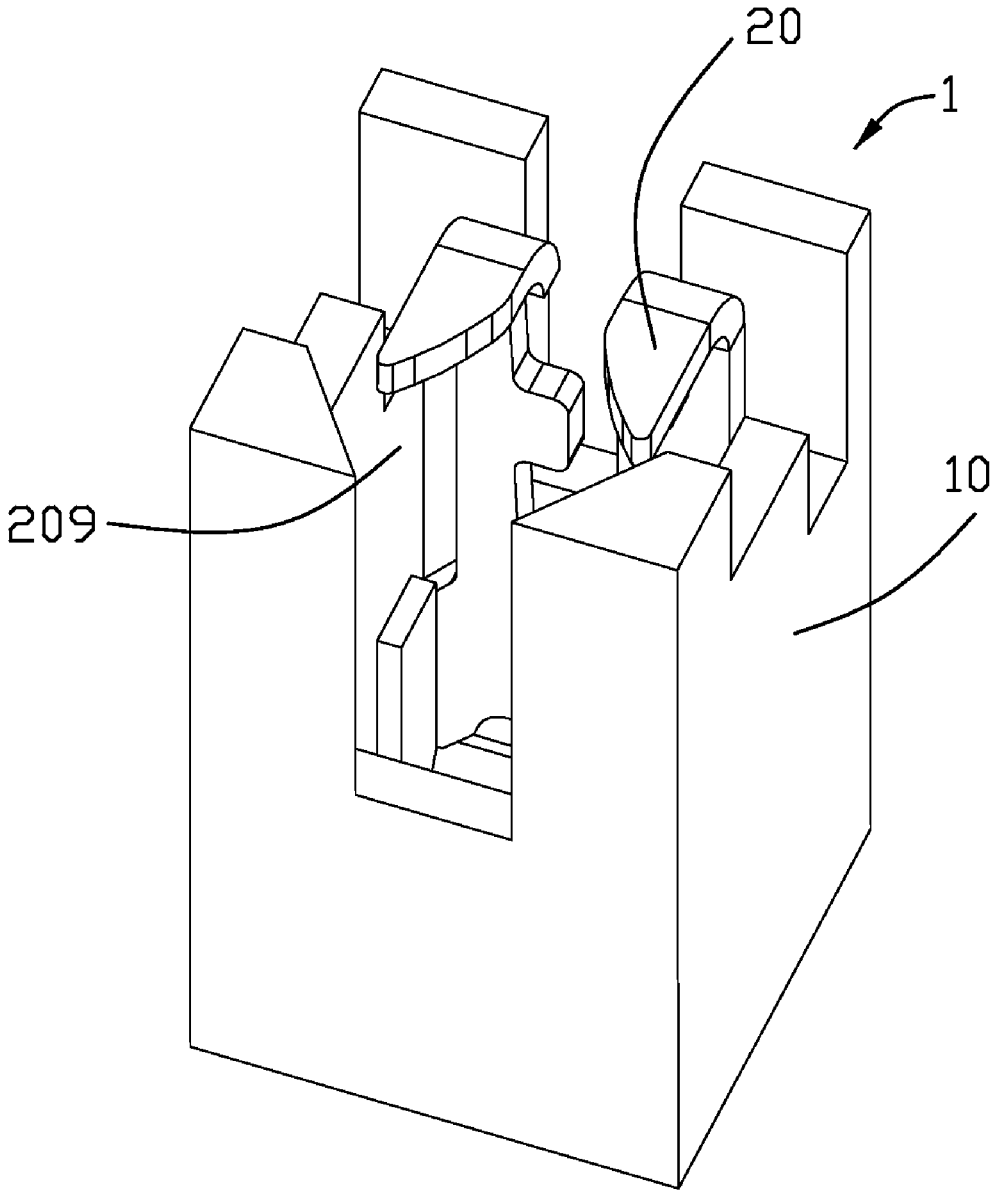
FIG. 1 is a perspective, assembled view of an electrical connector constructed in accordance with the present invention in a first embodiment.
Figure 2:
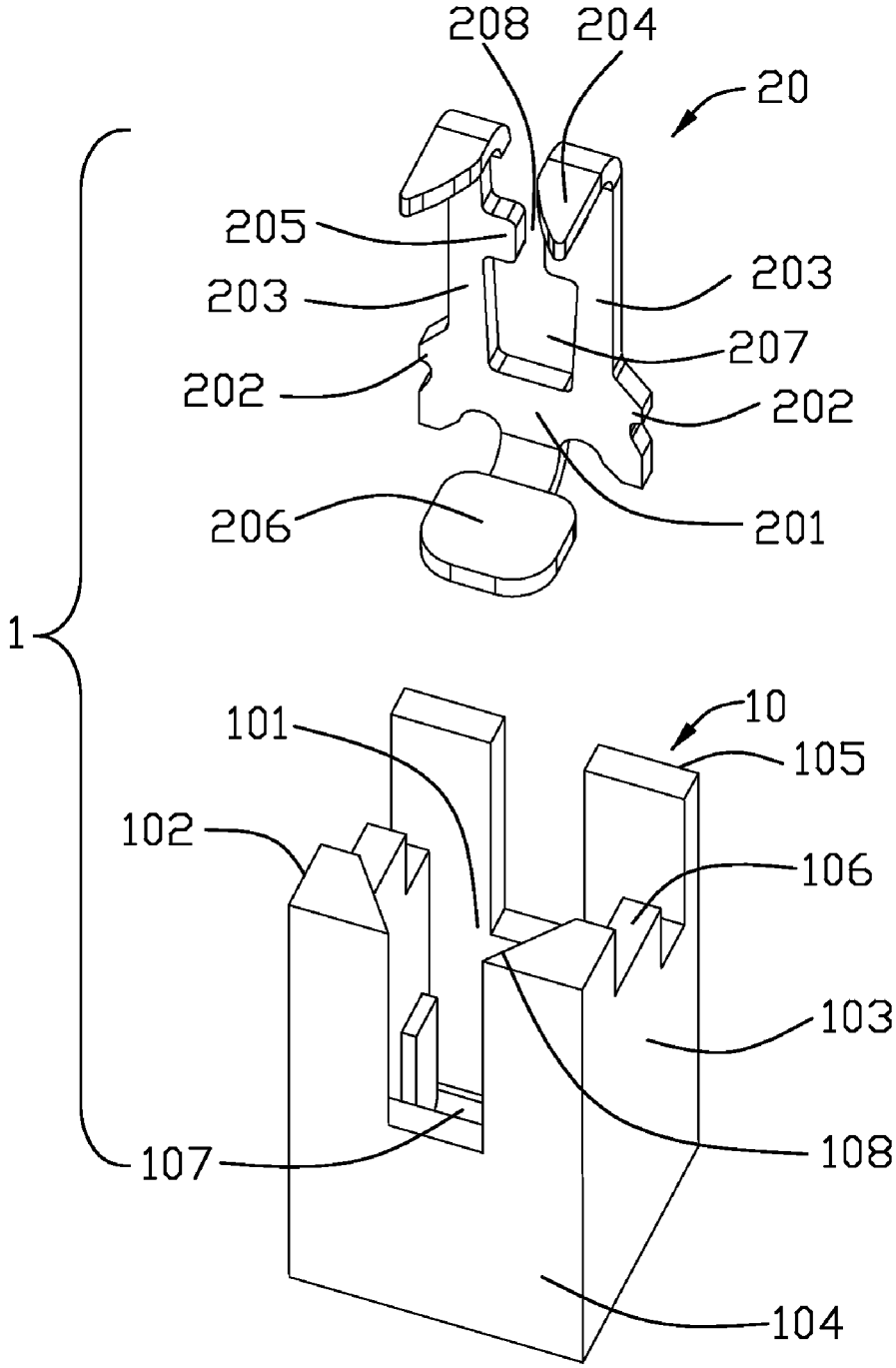
FIG. 2 is a perspective, exploded view of the electrical connector in FIG. 1.

Referring to FIGS. 1-2, an electrical connector 1 of the present invention, used for connecting a CPU (central processing unit, not shown) with a PCB (printed circuit board), comprises an insulative housing 10 defining a passageway 101 therein and an electrical contact 20 received in the passageway 101 of the insulative housing 10.

Referring to FIG. 2, the insulative housing 10 comprises a plurality of peripheral walls, which comprises a pair of first lateral walls 102, 103 each opposite and symmetrical to the other and a pair of second lateral walls 104, 105 each opposite to and unsymmetrical from the other. Each first lateral wall 102, 103 defines a stepped cutout 106 from an upper surface thereof Each second lateral wall 104, 105 defines a slit 107. Different to the rear lateral wall 105, the second lateral wall 104 further comprises a pair of slopes 108 extending towards the passageway 101.

Referring to FIGS. 1-2, the electrical contact 20 comprises an elongate planar base portion 201, a plurality of fixing portions 202 extending from two sides of the planar base portion 201, a pair of flexible arms 203 extending upwardly from the planar base portion 201 and being coplanar with the planar base portion 201, a pair of contact portions 204 extending from the flexible arms 203 and being orthogonal to the flexible arms 203 and the planar base portion 201, a pair of stopper portions 205 protruding oppositely from inner edges of the flexible arms 203 and a solder portion 206 orthogonal to the planar base portion 201 and extending parallel to the contact portions 204. The stopper portions 205 are coplanar with the planar base portion 201 and the flexible arms 203. The flexible arms 203 define a slot 207 terminated at the planar base portion 201. The stopper portions 205 extend into the slot 207 to define a gap 208 dimensioned smaller than the slot 207. The stopper portions 205 are not located too close to the planar base portion 201 with a distance not less than two thirds of a whole dimension of the flexible arm 203. The contact portions 204 are tapered away from the planar base portion 201 and define an insertion port 209 for guiding the pin leg of the CPU. The insertion port 209 is orthogonal to the slot 207 and communicates with the slot 207.

When a pin leg of the CPU is inserted into the insertion port 209 with zero insertion force and then, is guided into the contact portions 204 and is sandwiched therebetween. The pin leg mechanically and electrically connects with the contact portions 204 in general condition. If the pin leg is over-inserted, the stopper portion 205 prevents the pin leg from disengaging away from the contact portions 204. The pin leg achieves multiple contacts with the contact portions 204 and the stopper portion 205. During the insertion process, the pin leg moves nearer to the planar base portion 201. In an unusual condition, the pin leg of the CPU gets to the flexible arms 203, blocked by the stopper portion 205 to make multiple contacts with the contact portions 204 and the stopper portions 205. Because the insulative housing 10 defines a pair of stepped cutouts 106 on the first lateral walls 102, 103, the contact portions 204 are prevented interference for contacting with the first lateral walls 102, 103. Because the stopper portions 205 are stamped together with the flexible arms 203 and coplanar with the planar base portion 201 and the flexible arms 203, the electrical contact 20 of the present invention both saves cost and minimizes size, and furthermore, prevents over-slippage of the pin leg of the CPU to make sure electrical connection.

In an alternative embodiment of the present invention, the flexible arms 203 of the electrical contact 20 can also to be stamped as curved ones, acting as a pair of stoppers to prevents over-slippage of the pin leg of the CPU to make sure electrical connection.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector, comprising:

an insulative housing defining a passageway therein;

an electrical contact received in the passageway and comprising:

a planar base portion;

a pair of flexible arms coplanarly extending from the planar base portion;

a pair of contact portions extending from the flexible arms and being orthogonal to the flexible arms;

a stopper portion protruding from an inner edge of the flexible arm; and a solder portion being orthogonal to the planar base portion and opposite to the contact portions; wherein when a pin leg of a CPU is inserted therein, the pin leg moves gradually closer to the planar base portion and is sandwiched between the contact portions and capable of multiple contacting with the contact portions and the stopper portion.

2. The electrical connector as described in claim 1, wherein the flexible arms define a slot terminated at the planar base portion and the contact portions define an insertion port being orthogonal to the slot and communicating with the slot.

3. The electrical connector as described in claim 2, wherein the stopper portions extend into the slot.

* * * * *